US006810786B2

(12) United States Patent
Hinrichs

(10) Patent No.: US 6,810,786 B2
(45) Date of Patent: Nov. 2, 2004

(54) COMPRESSOR

(75) Inventor: Jan Hinrichs, Friedrichsdorf (DE)

(73) Assignee: Luk Fuhrzeug-Hydraulik GmbH & Co., KG, Bad Homburg (DE)

( * ) Notice: Subject to any disclaimer, the term of this patent is extended or adjusted under 35 U.S.C. 154(b) by 0 days.

(21) Appl. No.: 10/448,314

(22) Filed: May 23, 2003

(65) Prior Publication Data

US 2004/0028534 A1 Feb. 12, 2004

Related U.S. Application Data

(63) Continuation of application No. PCT/DE01/03779, filed on Sep. 26, 2001.

(30) Foreign Application Priority Data

Nov. 23, 2000 (DE) ..... 100 58 003

(51) Int. Cl.[7] ..... F04B 27/10
(52) U.S. Cl. ..... 92/12.2; 417/222.2
(58) Field of Search ..... 92/12.2; 417/222.2

(56) References Cited

U.S. PATENT DOCUMENTS 4,061,443 A 12/1977 Black et al.
4,175,915 A 11/1979 Black et al.
4,685,866 A 8/1987 Masaki et al.
4,729,719 A * 3/1988 Kayukawa et al. ..... 417/222.2
5,286,172 A * 2/1994 Taguchi ..... 417/222.2
5,842,834 A * 12/1998 Kawaguchi et al. ..... 417/222.2
6,663,355 B2 * 12/2003 Kubo et al. ..... 417/222.2

* cited by examiner

*Primary Examiner*—Thomas E. Lazo
(74) *Attorney, Agent, or Firm*—Darby & Darby

(57) ABSTRACT

In an air-conditioning compressor with a revolving wobble plate driven by a driving shaft, the variable piston stroke height is regulated by directing pressure medium to flow from the high-pressure outlet compartment to the piston-drive compartment and/or from the piston-drive compartment to the intake suction compartment of the compressor. The driving shaft has a tubular end portion extending into a recess of the cylinder head. The medium flow from the high-pressure area to the piston-drive compartment is routed along the outside of the end portion, while the flow from the piston-drive compartment to the intake area is routed through the hollow channel inside the end portion. A flow-resisting element is arranged between the outside of the end portion and the wall of the recess in the cylinder head, so that the flow resistance towards the cylinder head is significantly greater than in the direction towards the driving compartment.

10 Claims, 2 Drawing Sheets

COMPRESSOR

CROSS-REFERENCE TO RELATED APPLICATION

This application is a continuation of International Patent Application Ser. No. PCT/DE 01/03779, filed Sep. 26, 2001, which is hereby incorporated by reference in its entirety.

BACKGROUND OF THE INVENTION

The present invention relates to a compressor with a variable piston stroke or displacement volume, particularly an air-conditioning compressor for a motor vehicle, with a piston-drive mechanism in which a revolving wobble plate is driven by a driving shaft that is rotatably supported by parts of the compressor housing. The height of the piston stroke is variable and can be regulated by a flow of pressure medium from the high-pressure outlet compartment of the compressor to the driving compartment (i.e., the compartment that contains the wobble plate, also referred to herein as piston-drive compartment), and/or by a flow of pressure medium from the driving compartment to the intake suction compartment. An end portion of the driving shaft extends from the driving compartment into a housing part such as the cylinder head of the compressor. The inflow of pressure medium into the driving compartment can be realized at the outside surface of the end portion of the shaft, while the outflow of pressure medium from the driving compartment can be realized through a hollow space in the end portion of the shaft. Compressors with a variable piston stroke according to the foregoing description belong to the known state of the art. In these compressors, the end portion of the shaft that extends into the cylinder head can be used as a conduit and also as a separating wall between the streams of pressure medium flowing into and out of the driving compartment. For example, the inflow of pressure medium into the driving compartment may be routed along the outside wall of the end portion of the driving shaft. The outflow of pressure medium from the driving compartment to the low-pressure zone of the compressor can be routed through a hollow bore channel in the driving shaft. An important factor in this arrangement is the ability to seal the in-flowing pressure medium against the out-flowing pressure medium in the area of the end portion of the driving shaft. In the known state-of-the-art compressors, this sealing function is performed by a shaft seal ring that is inserted between the end portion of the driving shaft and the wall of the recess that receives the end portion of the driving shaft, e.g. in the cylinder head. The additional cost of the shaft seal rings and their installation represents a drawback of the state-of-the-art compressors of the foregoing description.

OBJECTIVE AND SUMMARY OF THE INVENTION

The present invention therefore has the objective to propose a compressor which, by virtue of its design concept, is free of the aforementioned disadvantages.

The invention offers a solution that meets the foregoing objective for a compressor with a variable piston stroke or displacement volume, particularly an air-conditioning compressor for a motor vehicle, with a piston-drive mechanism in which a revolving wobble plate is driven by a driving shaft that is rotatably supported by parts of the compressor housing. The variable height of the piston stroke can be regulated by a flow of pressure medium from the high-pressure outlet compartment of the compressor to the driving compartment, and/or by a flow of pressure medium from the driving compartment to the intake suction compartment. An end portion of the driving shaft extends from the driving compartment into a housing part such as the cylinder head of the compressor. The inflow of pressure medium into the driving compartment can be realized at the outside surface of the end portion of the shaft, while the outflow of pressure medium from the driving compartment can be realized through a hollow space in the end portion of the shaft. In the area where the pressure medium enters the flow path from the high-pressure zone to the driving compartment, the compressor according to the invention has a flow-resisting element or feature between the end portion of the driving shaft and the wall of the recess that receives the end portion of the driving shaft, e.g., in the cylinder head, so that the resistance to the flow of fluid is significantly greater in the direction towards the end of the shaft and into the cylinder head than the flow resistance of the conduits leading along the outside surface of the end portion of the shaft in the direction towards the driving compartment. According to a preferred concept of the inventive compressor, the stronger resistance to a fluid flow in the direction towards the end of the driving shaft is realized through a ring-shaped narrow gap between the end portion of the driving shaft and the wall of the recess that receives the end portion of the driving shaft.

In a preferred embodiment of the inventive compressor, the end portion of the driving shaft is represented by a tubular extension that is seated on the shaft.

A further embodiment of the compressor according to the invention is distinguished by a conveyor helix or screw thread which generates a propellant effect in the direction towards the driving compartment when the driving shaft is rotating. In another embodiment of the compressor according to the invention, the end portion of the driving shaft has a profile resembling a helical gear tooth profile, which likewise generates a propellant effect in the direction towards the driving compartment when the driving shaft is rotating.

In a further preferred embodiment of the invention, the end portion of the driving shaft has a conical shape that widens towards the end, so that the gap becomes narrower towards the end of the driving shaft.

Also preferred is an embodiment of the compressor where the gap works as a lubricant barrier or oil barrier. In yet another embodiment according to the invention, the lubricant film in the gap is used as a fluid seal against the gaseous pressure medium. Further preferred is an embodiment where the gap has a width of approximately 0.5 mm.

BRIEF DESCRIPTION OF THE DRAWINGS

The invention will be discussed in further detail based on several preferred embodiments that are illustrated in the drawings, wherein.

DETAILED DESCRIPTION OF PREFERRED EMBODIMENTS

Figure 1:
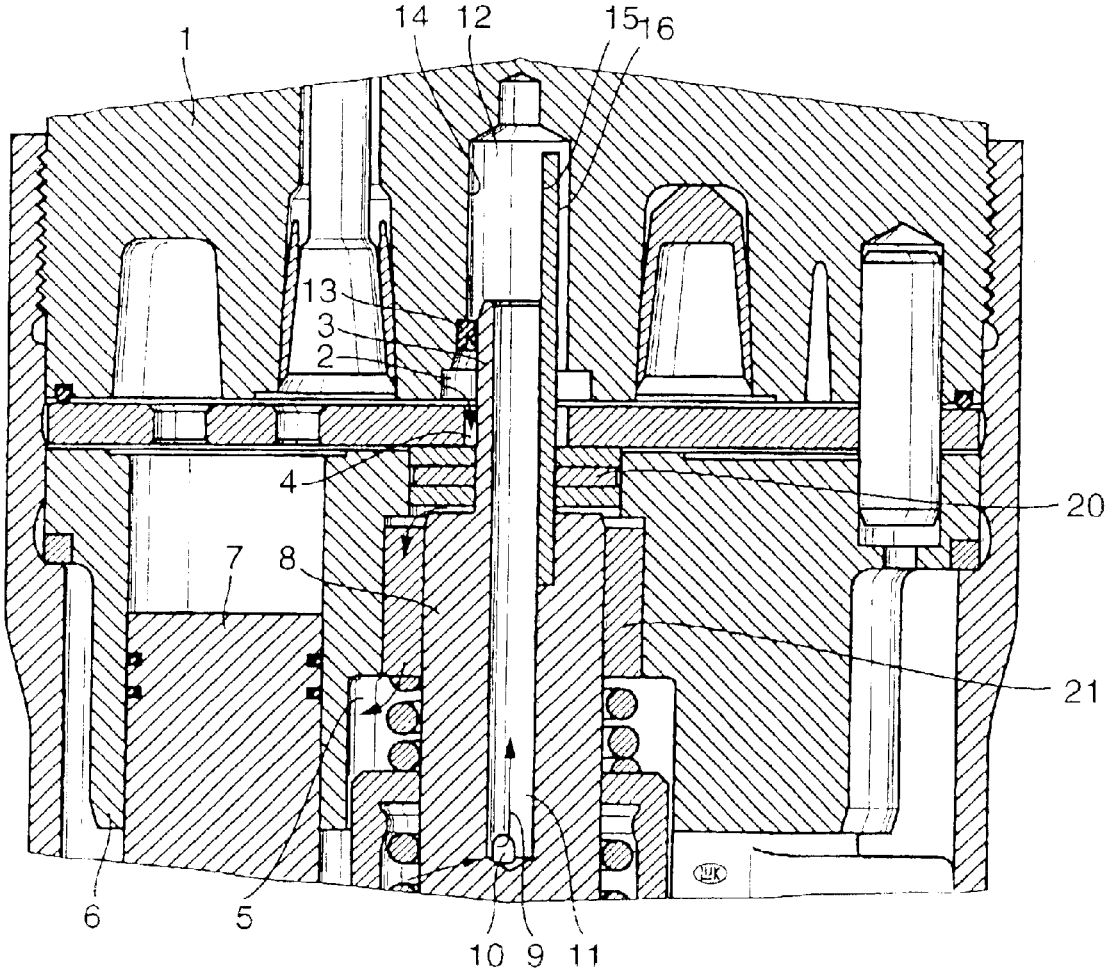
FIG. 1 represents the end portion of the driving shaft extending between the piston-drive compartment and the cylinder head.

FIG. 1 illustrates the features of the invention (to the right of the central axis) juxtaposed with the state of the prior art (to the left of the central axis).

FIG. 1 shows a cylinder head 1 in which a stream 2 of a pressure medium flows from an entry zone 2 at a shaft end portion 3 along the outside surface of the shaft 8 through two roller bearings 20, 21 into a piston-drive zone 5. The piston-drive space 5 receives a cylinder block 6 with reciprocating pistons 7. The reciprocating movement of the pistons 7 is driven by a revolving inclined disk, called a wobble disk (not shown in the drawing), which is connected to the driving shaft 8. The driving shaft 8 terminates in an end portion 3. The stream 9 of pressure medium flowing out of the piston-drive compartment passes through an opening 10 into a hollow space 11 inside the driving shaft 8 and the end portion 3. The hollow space 11 extends into the recess 12 that receives the shaft in the cylinder head 1. To prevent the stream 4 of pressure medium entering the piston-drive compartment from mixing with the stream 9 of pressure medium leaving the piston-drive compartment, there is a shaft seal 13 arranged between the end portion 3 of the shaft and the wall 14 of the recess 12. The arrangement with the shaft seal 13 as shown in the left half of FIG. 1 represents the existing state of the art.

According to the invention, the shaft seal 13 can be avoided if the resistance to the flow of pressure medium between the outside of the shaft end portion 3 and the wall 14 of the recess 12 is made large enough so that no significant part of the pressure medium stream 4 can flow from the entry zone 1 in the direction towards the end of the shaft and the recess 12. The right-hand part of FIG. 1 illustrates how the concept of a large flow resistance can be realized, e.g., by replacing the shaft end portion shown in the left-hand part of the drawing with a tubular extension 15 (as shown in the right-hand part of FIG. 1). A long and narrow annular gap 16 is formed between the outside surface of the tubular extension 15 and the wall 14 of the recess 16.

Figure 2:
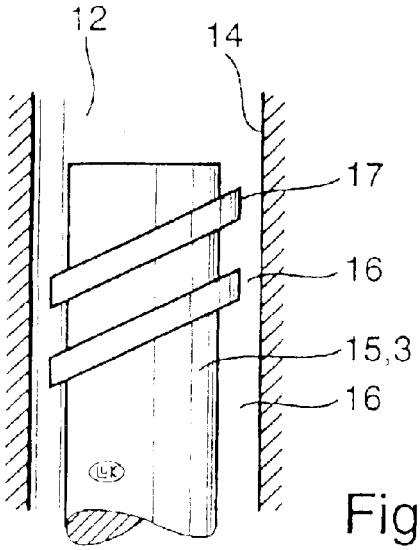
FIG. 2 represents a driving-shaft end portion with a conveyor helix.

FIG. 2 shows an inventive modification of the shaft end portion 3 or the tubular extension 15 by adding an external profile 17 in the shape of a conveyor helix or a screw thread. When the shaft 8 is rotating, the helix profile 17 in the gap 16 between the wall 14 and the shaft end portion 3 prevents the pressure medium from flowing in the direction towards the end of the shaft and propels the flow of pressure medium back to the piston-drive compartment 5. As is self-evident, the profile 17 can be integrally formed on the shaft end portion 3, or it can be configured as a separate tubular extension 15 that is seated on the shaft.

Figure 3:
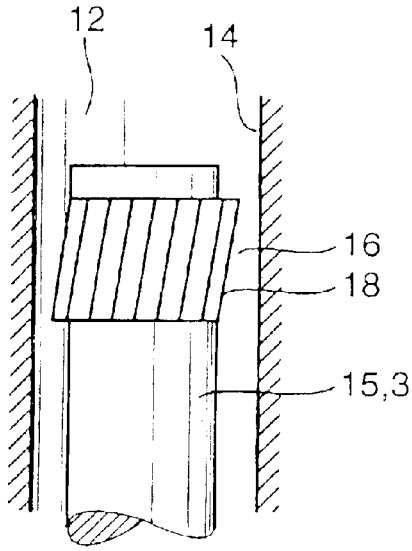
FIG. 3 represents a driving-shaft end portion with a helical gear tooth profile.

FIG. 3 illustrates a profiled shaft end portion 3 or tubular extension 15 in which a helical gear-tooth profile 18 is used to generate the conveyor effect propelling the medium back to the piston-drive compartment.

Figure 4:
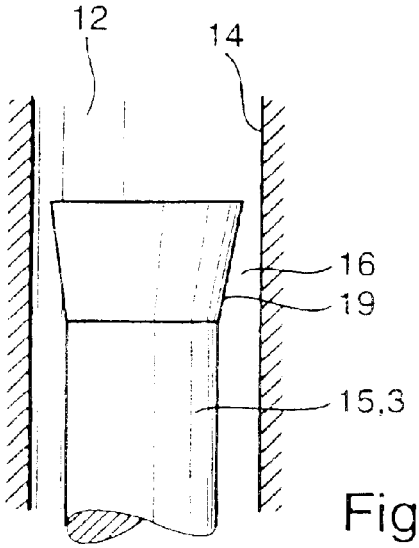
FIG. 4 represents a driving-shaft end portion terminating in a cone.

Finally, FIG. 4, shows a shaft end portion 3 or tubular extension 15 that terminates in a cone 19, so that the gap 16 has a narrowing taper towards the end of the shaft. This configuration has the advantage that the gap 16 can be accurately matched to specific design requirements.

What is claimed is:

1. A compressor comprising a compressor housing with a cylinder head, an intake suction compartment, a driving compartment, a high-pressure outlet compartment, a driving shaft rotatably supported in the compressor housing, cylinders extending parallel to the driving shaft in said compressor housing, a revolving wobble plate driven by the driving shaft in the driving compartment, pistons driven by said wobble plate to perform a reciprocating movement in said cylinders, wherein said reciprocating movement has a variable stroke height that can be regulated by selectively directing at least one of a first flow of pressure medium from the high-pressure outlet compartment to the driving compartment and a second flow of pressure medium from the driving compartment to the intake suction compartment, wherein the driving shaft has an end portion extending from the driving compartment into a recess of the cylinder head, said first flow of pressure medium is directed along an outside surface of said end portion and said second flow is directed through a hollow space in the end portion, and wherein the end portion terminates in a flow-resisting element arranged between said end portion and a wall of said recess to resist a leakage from said first flow towards the cylinder head by presenting a significantly greater flow resistance in the direction into the cylinder head than the flow resistance encountered by said first flow along said outside surface into the driving compartment.

2. The compressor of claim 1, wherein the compressor is an air-conditioning compressor of a motor vehicle.

3. The compressor of claim 1, wherein the flow-resisting element comprises a ring-shaped gap between said end portion and a wall of said recess.

4. The compressor of claim 3, wherein the end portion comprises a tubular extension that is seated on the driving shaft.

5. The compressor of claim 3, wherein the flow-resisting element comprises a conveyor helix that generates a propellant effect in the direction towards the driving compartment when the driving shaft is rotating.

6. The compressor of claim 3, wherein the flow-resisting element comprises a helical gear tooth profile that generates a propellant effect in the direction towards the driving compartment when the driving shaft is rotating.

7. The compressor of claim 3, wherein the flow-resisting element comprises a conical taper of the end portion, so that the gap becomes narrower in the direction towards the cylinder head.

8. The compressor of claim 3, wherein the gap acts as a lubricant barrier.

9. The compressor of claim 3, wherein the pressure medium comprises a gaseous medium and the gap holds a lubricant film acting as a fluid seal to prevent passage of said gaseous medium.

10. The compressor of claim 3, wherein the gap has a width of approximately one-half millimeter.

* * * * *

UNITED STATES PATENT AND TRADEMARK OFFICE

CERTIFICATE OF CORRECTION

PATENT NO. : 6,810,786 B2
DATED : November 2, 2004
INVENTOR(S) : Jan Hinrichs

It is certified that error appears in the above-identified patent and that said Letters Patent is hereby corrected as shown below:

Title page,
Item [73], Assignee, delete "Luk Fuhrzeug-Hydraulik Gmbh & Co., KG" and substitute -- Luk Fahrzeug-Hydraulik GmbH & Co., KG --.

Signed and Sealed this

Fifteenth Day of March, 2005

JON W. DUDAS
*Director of the United States Patent and Trademark Office*